United States Patent [19]

Parker, Jr.

[11] Patent Number: 4,953,541

[45] Date of Patent: Sep. 4, 1990

[54] INTERCHANGEABLE PASSIVE EXERCISING APPARATUS

[76] Inventor: Alonzo E. Parker, Jr., 1031 Plum St., Durham, N.C. 27703

[21] Appl. No.: 347,466

[22] Filed: May 4, 1989

Related U.S. Application Data

[63] Continuation-in-part of Ser. No. 245,024, Sep. 16, 1988, Pat. No. 4,827,913.

[51] Int. Cl.[5] ..... A61H 1/02

[52] U.S. Cl. ..... 128/25 R; 128/70

[58] Field of Search ..... 128/25 R, 69, 70, 71, 128/72, 73, 74; 272/144; 269/322, 325

[56] References Cited

U.S. PATENT DOCUMENTS

| | | | |
|---|---|---|---|
| 1,276,655 | 8/1918 | Housholder | 128/72 |
| 1,686,979 | 10/1928 | McManis | 128/25 R |
| 2,139,166 | 12/1938 | Leuchter | 128/25 R |
| 2,598,204 | 5/1952 | Allen | 128/25 R |
| 2,931,354 | 4/1960 | Sellner | 128/74 |
| 3,071,130 | 1/1963 | Hoyer et al. | 128/25 R |
| 4,723,537 | 2/1988 | Parker, Jr. | 128/25 R |
| 4,827,913 | 5/1989 | Parker | 128/25 R |
| 4,834,072 | 5/1989 | Goodman | 128/25 R |
| 4,844,453 | 7/1989 | Hestilow | 272/903 X |
| 4,856,497 | 8/1989 | Westphal | 128/70 |

*Primary Examiner*—Richard J. Apley
*Assistant Examiner*—H. N. Flaxman
*Attorney, Agent, or Firm*—Olive & Olive

[57] ABSTRACT

A passive exercising apparatus comprises a first stationary horizontal platform supported on a first frame detachably connected to a second frame supporting a second platform forming a lengthwise extension of the first platform and connectable thereto for relative pivotal or rotative movement, a drive mechanism supported on the second frame below the second platform, adjustable linkages connected to the drive mechanism enabling the second platform to be selectively pivoted up-and-down or about its central longitudinal axis or both so as to vary the type of exercise obtained, a third horizontal stationary platform in the form of a bench having a third frame detachably connectable to the second frame of the second platform and a fourth set of leg support members on a fourth frame detachably connectable to the second frame of the second platform with means connected to said drive mechanism to drive said leg support members and exercise the legs of the user.

10 Claims, 4 Drawing Sheets

INTERCHANGEABLE PASSIVE EXERCISING APPARATUS

RELATION TO COPENDING APPLICATION

This application represents a continuation-in-part of and an improvement over the exercising apparatus disclosed in applicant's copending application Ser. No. 07/245,024, filed Sept. 16, 1988 entitled "Improved Passive Exercising Apparatus" to issue as U.S. Pat. No. 4,827,913 which in turn represented an improvement over the invention disclosed in applicant's prior U.S. Pat. No. 4,723,537 entitled "Passive Exercising Apparatus."

BACKGROUND OF THE INVENTION

1. Field of the Invention

The present invention relates to an exercising apparatus, and in particular, to a passive exercising apparatus having interchangeable components.

2. Description of the Related Art

U.S. Pat. No. 3,674,017 teaches a passive exercising apparatus which moves the torso with respect to the legs or from a prone to a sitting position. The apparatus incorporates a first stationary table and a second table which pivots relative to the first. However, such apparatus does not allow the body to be twisted or to be simultaneously twisted and pivoted to enhance exercising of stomach and back muscles or to pivot any portion of the body below a horizontal plane.

The passive exercising apparatus of U.S. Pat. No. 2,598,204 allows portions of the body to be pivoted below a horizontal plane. However, the apparatus does not provide for twisting of the body or for simultaneous twisting and pivoting.

U.S. Pat. No. 2,494,746 also teaches a passive exercising apparatus which imparts vertical and horizontal reciprocating as well as circular motion to a body table. However, this apparatus cannot be adjusted so as to selectively deliver either a pivoting or twisting motion, or both pivoting and twisting motions simultaneously.

U.S. Pat. No. 3,472,222 teaches twisting the head only but otherwise lacks the ability to pivot or twist major portions of the body.

U.S. Pat. No. 3,735,754 teaches use of four reciprocating platforms but with no ability to pivot or twist the body.

Applicant's prior U.S. Pat. No. 4,723,537 teaches a passive exercising device having a fixed table and a moveable table. The moveable table pivots with respect to the fixed table by means of a drive mechanism. The drive mechanism is connected to linkages which impart an up-and-down and/or oscillating motion to the moveable table. A substantial improvement over the aforementioned prior art apparatus is thus provided by the exercising apparatus described in the aforementioned U.S. Pat. No. 4,723,537. However, none of the mentioned prior art provides passive exercising components which can be easily separated and detachably connected to the drive mechanism of a moveable table.

The apparatus of applicant's invention as disclosed in copending application Ser. No. 07/245,024 incorporates a fixed table supported on a frame and a moveable table supported on adjustable linkages operated by a pair of slotted lever arms on a common drive shaft. At least one of the slotted lever arms is adjustable on the shaft with respect to its angular relation to the other slotted lever arm. The lever arm shaft is driven by a motor drive.

The fixed table connects to and supports the moveable table through a hinge connection which can both pivot and rotate. One mode of operation enables the moveable table to be pivoted about a fixed longitudinal central axis and in a relatively high or relatively low pivoting motion dependent on how the linkages and slotted lever arms are connected. In another mode of operation, the linkages and slotted lever arms can be connected so as to either pivot the moveable platform around a fixed horizontal axis at one end of the fixed platform or pivot the moveable platform around a central longitudinal axis to twist the body or simultaneously pivot and twist the selected portion of the body. Thus, further improvements in a passive exercising apparatus are provided by the apparatus of copending application Ser. No. 07/245,024.

The present invention has as one object that of preserving all of the features of the exercising apparatus disclosed in applicant's prior U.S. Pat. No. 4,723,537 and copending application Ser. No. 07/245,024. Another object is that of providing detachable components adding additional optional leg exercise features and additional optional body exercises obtained with lower portions of the body in a stationary position. Other objects will appear as the description proceeds.

SUMMARY OF THE INVENTION

The exercising apparatus of the present invention has a first stationary table which can be detached from or detachably secured to a second moveable table having a drive mechanism and linkages arranged to operate in the manner of the moveable table described in applicant's copending application Ser. No. 07/245,024. There is also provided a third leg support structure arranged to be detached from or detachably secured to the second moveable table and to be driven by the same drive mechanism so as to provide leg exercise. A fourth stationary bench member can also be detachably and fixedly secured to the second moveable table to provide exercises in which the user's legs assume a position overhanging the bench member.

DETAILED DESCRIPTION OF THE PREFERRED EMBODIMENTS

Figure 1:
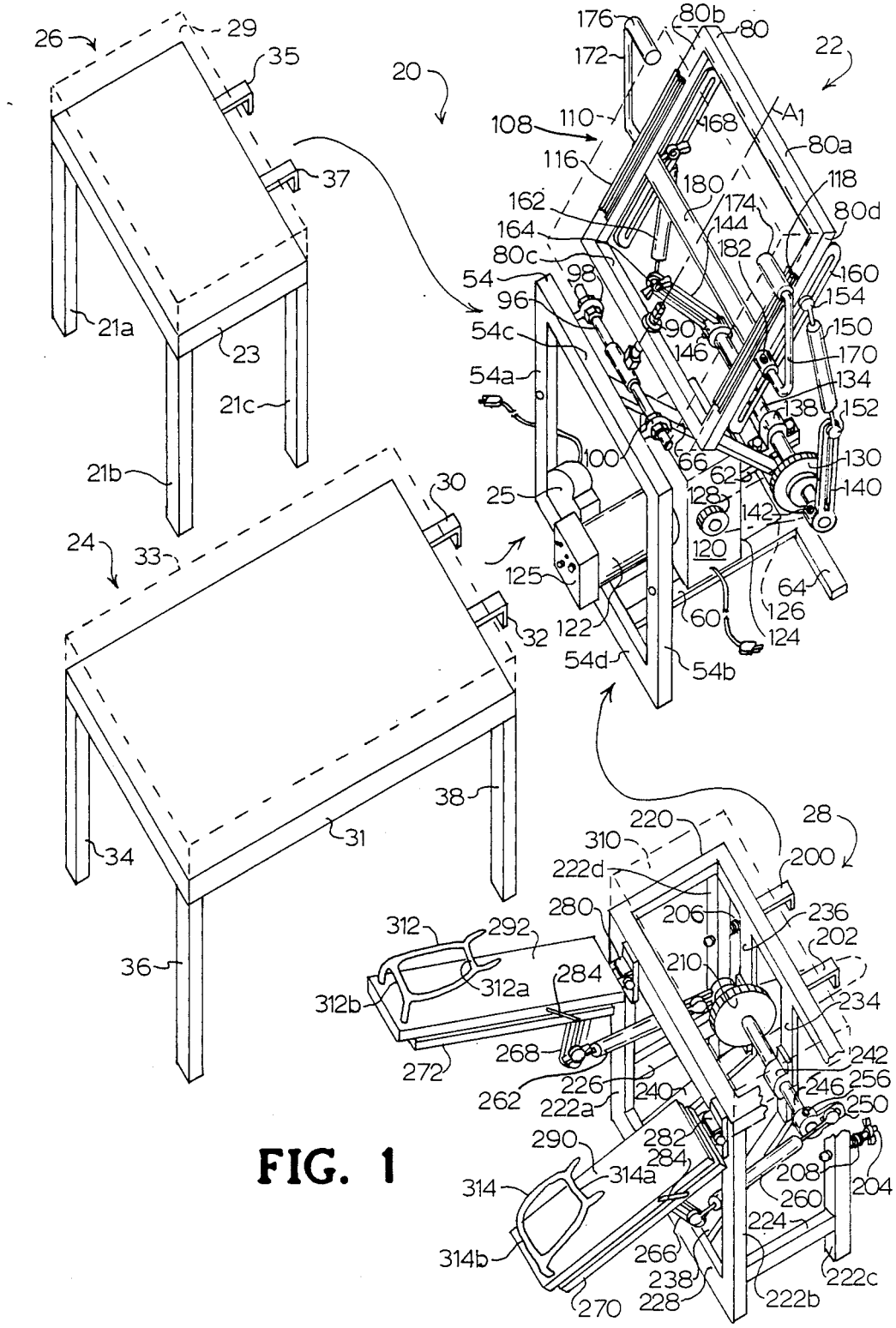
FIG. 1 is a perspective view of the several interchangeable components comprising the passive exercising apparatus of the invention and illustrating a detached moveable table which can be detachably secured to either the illustrated stationary table, the illustrated stationary bench or the illustrated moveable leg supports driven from the drive mechanism of the moveable table.
Figure 2:
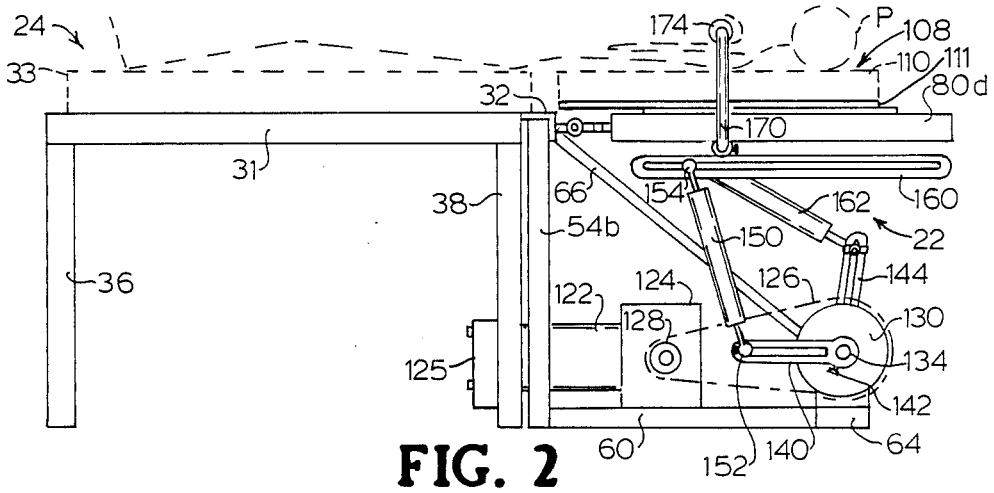
FIG. 2 is a side elevation view of the moveable table component of FIG. 1 detachably secured to the stationary fixed table component of FIG. 1 and illustrating an operating mode in which the moveable table is substantially planar with the fixed table and the slotted lever arms of the drive mechanism are angularly displaced from one another; user supporting cushions and a supporting platform on the moveable table are indicated in dashed lines.

Making reference initially to FIG. 1, the exercising apparatus 20 of the invention comprises a driven moveable table 22 which can be detachably secured to either a stationary table 24, a stationary bench 26 or a driven leg exercising apparatus 28. All of the respective components are fitted with suitable cushions which are supported on suitable platform, bench or table surfaces and which are generally shown in dashed lines to permit illustration of other elements of the invention. When the fixed table 24 is detachably secured to the moveable table 22 by means of the overlapping L-shaped brackets 30,32 and is positioned in such interconnected position as illustrated in FIG. 2, the user may place the lower portion of his/her body on the fixed table 24 and the user's upper body on the moveable table 22. Alternatively, the user may place the upper portion of his/her body on fixed table 24 and the lower portion on moveable table 22. It is preferred that the top surface of the stationary table 24 when in use be substantially horizontal. The moveable table 22, as illustrated, is capable, with proper adjustment of the linkages, of pivoting with respect to the stationary table 24 from a position slightly below the plane of the fixed table 24 to a position approximately perpendicular to the plane of the fixed table 24. Thus it can be seen that when the stationary table 24 and moveable table 22 are detachably interconnected all of the numerous exercises obtainable by the apparatus of prior U.S. Pat. No. 4,723,537 and of copending application Ser. No. 07/245,024 are immediately obtainable with the apparatus of the present invention. In addition, numerous other exercises are provided when either the stationary bench component 26 or the moveable leg exercising apparatus 28 are detachably secured to the table 22.

As previously mentioned, the exercise apparatus 20 of the invention also includes a stationary bench member 26 which can be detachably secured to the moveable table 22 and further includes a moveable leg exercising apparatus 28 which also can be detachably secured to and driven by the drive mechanism of the moveable table 22. The description will first be directed to describing more specifically the operation of the invention apparatus when the stationary table 24 and moveable table 22 are detachably secured together and will then proceed to describing how the invention apparatus operates when the bench member 26 is detachably secured to the moveable table 22 and finally how the leg exercising apparatus 28 operates when detachably secured to the moveable table 22.

Stationary fixed table 24 comprises a horizontal top member 31 constructed from sheet metal or other suitable material and four vertical legs 34, 36, 38 and 40 (not shown) secured to top 31. In use, top 31 supports a suitable cushion 33 indicated in dashed lines in FIGS. 1 and 2.

Stationary fixed bench 26 comprises a horizontal top member 23 constructed from sheet metal or other suitable material and four vertical legs 21*a*, 21*b*, 21*c* and 21*d* (not shown). Brackets 35, 37 enable bench 26 to be detachably secured to the moveable table 22 as illustrated with cushion 29 supported on top 23.

Moveable table 22 is self-supporting and includes a vertical rectangular closed frame 54 constructed from tubular metal or other suitable material and made up of suitably joined side members 54*a*, 54*b* and top and bottom members 54*c*, 54*d*. Cross braces, not shown, may be utilized to stabilize frame 54. A pair of parallel, spaced apart, base members 60, 62 are secured to bottom frame member 54*d* and extend to a bottom cross support member 64 to which base members 60, 62 are secured. An angled brace 66 is secured at one upper end to frame member 54*c* and at the opposite end to cross support member 64.

Figure 5:
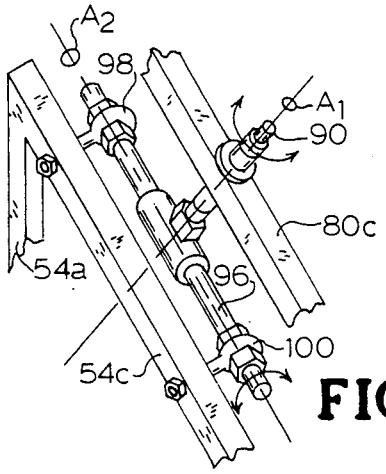
FIG. 5 is an enlarged partial perspective view of the connection assembly supported on the moveable table frame enabling the moveable table to tilt about its central axis and about an axis perpendicular thereto or simultaneously about both axes.
Figure 10:
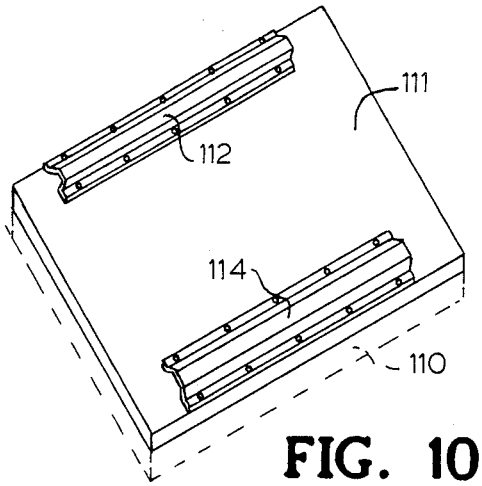
FIG. 10 is a bottom view of a slideable cushion platform support employed with the moveable table.

Moveable table 22 further includes a rectangular frame member 80 constructed from tubular metal or the like and made up of suitably joined end members 80*a*, 80*c* and side members 80*b*, 80*d*. The moveable frame 80 is connected to the fixed frame 54 through a shaft 90 passing through a suitable bearing mounted in frame member 80*c* and about which the entire frame 80 is free to rotate about the axis of shaft 90 which also constitues a central longitudinal axis passing through frame 80 and designated axis $A_1$. Shaft 90 is in turn fixedly secured to another shaft 96 in a T configuration with shaft 96 being free to rotate in a pair of bearings 98, 100 supported on the fixed frame member 54*c*. Thus, frame 80 is free to rotate about the fixed horizontal axis $A_2$ (FIG. 5) extending through shaft 96 and which is perpendicular to axis $A_1$. Frame 80 supports a cushion assembly 108 indicated in dashed lines in FIGS. 1 and 2 for purposes of illustration. Cushion assembly 108 includes a cushion 110 and moveable cushion platform 111 fitted with guide rails 112, 114 (FIG. 10) mated to fit guide rails 116, 118 secured to frame 80 such that the cushion 110 can slide back and forth with its platform 111 as the moveable table 22 goes through its various motions. This enables the body portion of user P supported on the moveable table to move relative to the moveable table 22 when the moveable table 22 is moving up and down about the axis $A_2$ of shaft 96.

Figure 11:
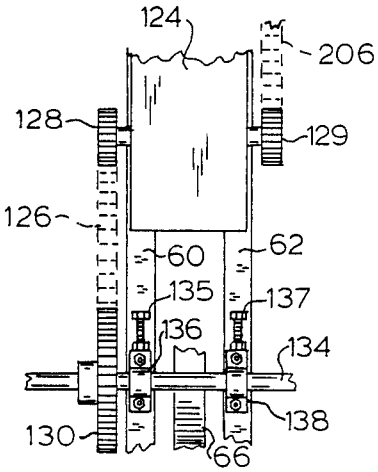
FIG. 11 is a partial plan view of the drive and driven sprockets of the moveable table.

Drive mechanism 120 below platform 111 comprises a motor 122, preferably a variable speed electric motor, coupled to a gear reducer 124 and with an appropriate control panel 125. Reducer 124 is mounted on the previously mentioned frame members 60, 62. Motor 122 through gear reducer 24 and chain 126 drives sprockets 128 and 130. Sprocket 130 is fixedly mounted on shaft 134 which is supported by bearings 136, 138 (FIG. 11) mounted on the respective base frame members 60, 62. Chain tension is adjusted by screws 135, 137.

Figure 9:
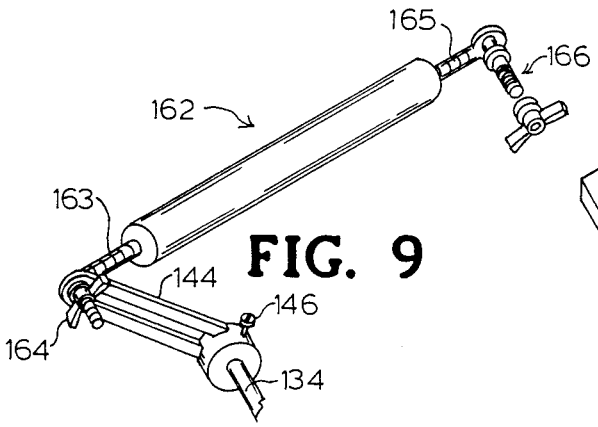
FIG. 9 is a perspective view of a portion of the adjustable drive linkage of the type used with both the moveable table and the leg exercising apparatus.
Figure 8:
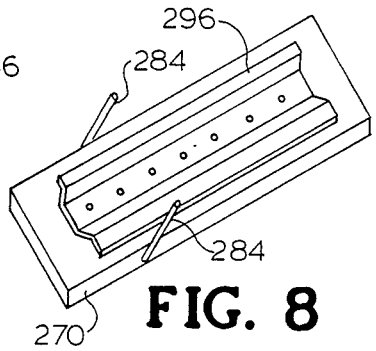
FIG. 8 is a top perspective view of the bottom leg support used in the leg exercising apparatus.

At a first end of shaft 134, slotted lever arm 140 is removably and adjustably mounted on shaft 134 by means of a set screw 142 (FIG. 2). At the opposite end of shaft 134, slotted lever arm 144 is removably and adjustably mounted on shaft 134 by another set screw 146 (FIG. 9). Through the use of the set screws 142, 146, slotted lever arms 140, 144 may be adjustably mounted on shaft 134 at any desired angular position with respect to each other. As will be described below, by varying the position of one slotted lever arm with respect to the other slotted lever arm, different up and down or tilt or up and down and tilt motions of moveable table 22 are achieved. As an alternative to the embodiment of the apparatus 20 illustrated in the drawings, only one slotted lever arm need be adjustably connected to shaft 134 to position the lever arm at a desired angular position with respect to the other slotted lever arm. What is also to be emphasized is that these motions can be applied to the user's body when either the bench member 26, the table member 24 or the leg exercising apparatus 28 are attached to the moveable table 22.

Linkage 150, generally of the same type as illustrated in FIG. 9, is removably and adjustably connected at a first end to slotted lever arm 140 by means of a wing nut secured, threaded fastener 152. At a second end, linkage 150 is removably and adjustably connected by a similar wing nut secured, threaded fastener 154 to a slotted bracket 160 mounted on the underside of frame 80. In a similar manner linkage 162 is removably and adjustably connected at a first end to slotted lever arm 144 by a wing nut secured, threaded fastener 164. At a second end linkage 162 is removably and adjustably connected by a wing nut secured, threaded fastener 166 to a slotted bracket 168 mounted on the underside of frame 80. It will be understood that the respective first ends of linkages 150, 162 may be mounted at any position in the respective slots of slotted lever arms 140, 144. Furthermore, the respective second ends of linkages 150, 162 may be mounted at any position in the respective slots of slotted brackets 160, 162. Further, the lengths of the linkages 150, 162 may be adjusted by means of the threaded links such as links 163, 165 seen in FIG. 9. Thus, a wide range of motions are readily obtained.

A pair of U-shaped arm rest bars 170, 172 are provided with hand grips 174, 176 and each has one end mounted within mounting bar 180 secured to frame 80 so as to be angularly positionable with respect to mounting bar 180 and also such that both of the hand bars 170, 172 can be moved in and out with respect to frame 80 utilizing the respective set screws 182 (FIG. 1), 184 (not shown).

Figure 4:
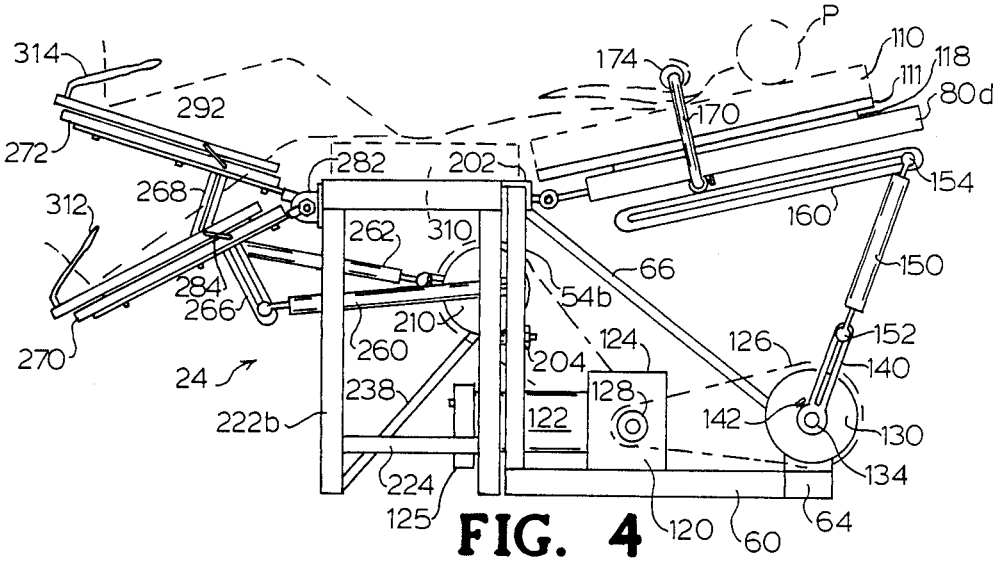
FIG. 4 is a side elevation view of the detachably secured moveable table and leg exercising apparatus components illustrating the slotted lever arms substantially aligned with one another in a third position for a third mode of operation; a user, supporting cushions and a supporting platform on the moveable table are illustrated in dashed lines with the user's feet engaging foot bars.
Figure 6:
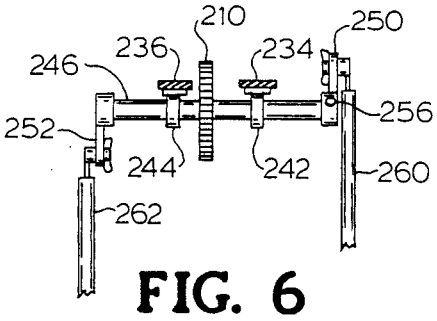
FIG. 6 is a partial plan view of the drive sprockets and linkages for the leg exercising apparatus.
Figure 7:
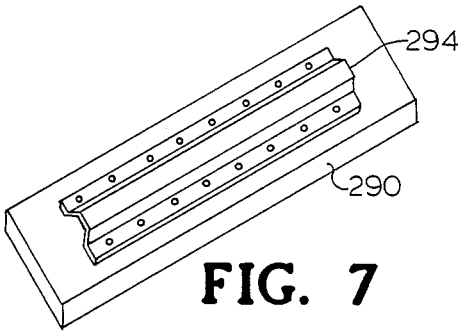
FIG. 7 is a bottom perspective view of the upper leg support used in the leg exercising apparatus.

It will next be assumed that the fixed table 24 is adjustably secured to the moveable table 22 and that the appropriate cushions, indicated in dashed lines, are installed on both the fixed table 24 and moveable table 22. In operation, three types of movement of the moveable table 22 can be obtained as the drive mechanism rotates the slotted lever arms 140, 144 and linkages 150, 162. A first movement involves pivoting the moveable table frame 80 about the axis $A_2$ of the connecting shaft 96. This up and down motion occurs as the moveable table 22 travels from a first position substantially planar to the fixed table 24 (or slightly below the plane of fixed table 24) to a second position approximately perpendicular to the fixed table 24. Of course, the range of this up and down motion can be varied by adjusting the length of the linkages and the placement of the ends of linkages 150, 162 in the slotted lever arms 140, 144 and in the slotted brackets 160, 162. This first type of movement ("up and down") is achieved when the slotted lever arms 140, 144 are positioned on shaft 134 so that they are substantially angularly aligned with respect to each other as in FIG. 4. In other words, each slotted lever arm 140, 144 is arranged to be at substantially the same angular position with respect to shaft 134.

A second type of motion of the moveable table 22 involves pivoting about the axis $A_1$ of the shaft 90 on which the frame 80 of moveable table 22 is mounted. This motion imparts a twisting or oscillating motion to the user represented by the arrow in FIG. 3. This oscillating motion is achieved when the slotted arms 140, 144 are positioned on shaft 134 so that they are approximately 180 degrees apart from one another as in FIG. 3. The range of oscillation about the axis of shaft 90 can thus be easily varied by adjusting the length of the linkages and the positions at which the linkages 150, 162 are secured to the slotted lever arms 140, 144 and the slotted brackets 160, 162. A third type of motion of the moveable table 22 involves combined pivoting about the respective axes of shaft 90 and shaft 96. This combined motion causes the moveable table 22 to travel up and down about the axis $A_2$ of shaft 96 and simultaneously oscillate about the axis $A_1$ of shaft 90. The range of movement about these axes can also be varied by adjusting the lengths of the linkages and the positions of the linkages 150, 162 at the slotted lever arms 140, 144 and the slotted brackets 160, 162. This combined motion is achieved when the slotted lever arms 140, 144 are angularly displaced from one another less than approximately 180 degrees on shaft 134 as illustrated in FIG. 2.

Figure 3:
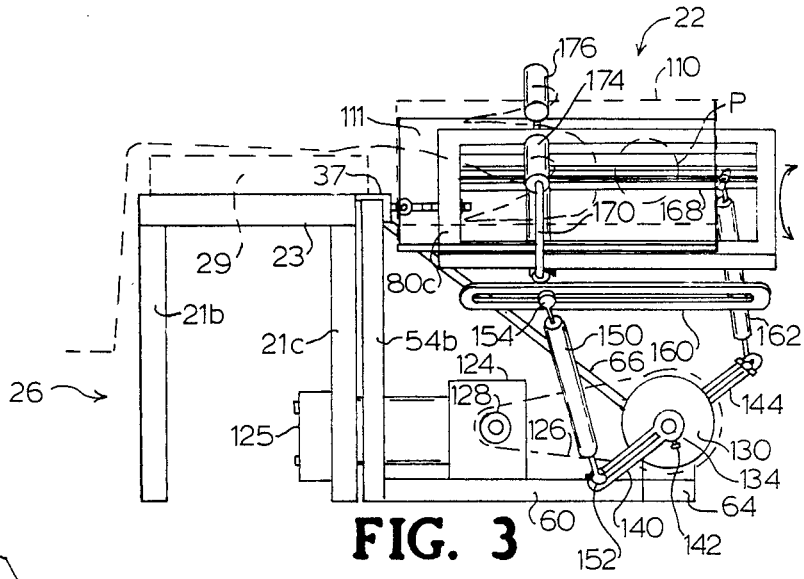
FIG. 3 is a side elevation view of the detachably secured table and bench components illustrating the slotted lever arms angularly displaced approximately 180 degrees from one another in a second position and with the moveable table tilted; a user with legs hanging down from the bench and supporting cushions are illustrated in dashed lines.

What can be seen from the foregoing description is that when either the stationary table 24, the stationary bench 26 or the moveable leg exercising apparatus 28 are detachably secured to the moveable table 22 any of the described several body movements can be imposed on that portion of the body resting on the moveable table 22 with respect to those portions of the body resting on either the stationary table 24, stationary bench 26 or moveable leg exercising apparatus 28. An electrically energized frame vibrator 25 may also be employed with any of the apparatus for added benefit. It will also be clear from the foregoing description that when the moveable table 22 is detachably secured to either the stationary table 24, the stationary bench 26 or the moveable leg exercising apparatus 28, the linkages for the moveable table 22 can be arranged in either of the different positions shown in FIGS. 2, 3 or 4 or in other positions not shown. It is also to be recognized that when the stationary bench member 26 is detachably secured to the moveable table 22, the user P, indicated in dashed lines, may assume a position wherein portions of the user's body overhang the bench member 26 as illustrated in FIG. 3. Thus, by selecting the particular exercising component, i.e., the stationary table 24, stationary bench 26 or moveable leg exercising apparatus 28 to be detachably secured to the moveable table 22, any of a very wide range of passive exercises become possible.

In another aspect of the invention, the leg exercising apparatus 28 is secured to the moveable table apparatus 22 by means of the brackets 200, 202 and adjustable chain tightening bolts 204, 206. Spacers 208 are added or removed as required to tighten chain 126. Drive chain 206 can be arranged to connect the leg exercising apparatus drive sprocket 210 to the moveable table drive sprocket 129 (FIG. 1). The moveable table exercising motions and the leg exercising motions are thus able to operate simultaneously in any of a variety of modes and be driven by the same drive mechanism.

Exercising apparatus 28 includes a top rectangular frame 220 supported by legs 222*a*, 222*b*, 222*c* and 222*d*, side braces 224, 226 and front bottom brace 228. Vertical braces 234, 236 connect to angled braces 238, 240 and support bearing blocks 242, 244 (FIG. 1) which mount the sprocket shaft 246 on which sprocket 210 is mounted. Additional braces not shown, may be added as required for the particular construction employed.

Sprocket shaft 246 mounts crank arms 250, 252 illustrated as being adjustably offset and which respectively connect at the driven end to linkages 260, 262 of the adjustable length type shown in FIG. 9. Linkages 260, 262 connect at the opposite end to a pair of downwardly extending slotted brackets 266, 268 fixedly secured respectively to a pair of plate members forming bottom leg supports 270, 272. Leg supports 270, 272 pivot on the frame of exercising apparatus 28 by means of pivotal connections 280, 282. Thus, as sprocket 210 is driven, crank arms 250, 252 cause the bottom leg supports 270, 272 to pivot up and down. A pair of top leg supports 290, 292 slidably mount on the bottom leg supports 270, 272 by means of pairs of mating guide rails 294, 296 such that top leg support 290 glides back and forth on bottom leg support 270 and top leg support 292 glides back and forth on bottom leg support 272. Elastic cord or spring connectors 284, connect each top leg support, e.g., top leg support 290, to its respective bottom leg support, e.g., bottom leg support 270. The buttocks and upper portion of the user's body thus typically rests on cushions 310, 110 shown in dashed lines in FIG. 4 while the user's legs rest on the respective top leg supports 290, 292. The user's feet engage the respective foot support bars 312, 314 by engaging either foot bars 312*a*, 314*a*, for example, or foot bars 312*b*, 314*b* when a longer leg reach is desired.

The extent of up and down motion imparted to the respective bottom leg supports 270, 272 can be regulated by adjusting the length of the respective linkages 260, 262. The relative positions of the bottom leg supports 270, 272 can also be regulated by changing the angular positions of crank arms 250, 252 on the sprocket shaft 210 utilizing set screws 256, 258 (not shown) thus providing a wide range of motions in the leg exercising apparatus 28. It will also be appreciated that the exercising motions afforded by the moveable table 22 can be altered by quickly and easily changing the angular orientation of the slotted crank arms 140, 144 on the drive shaft 134. Additionally, a range of different motions are afforded by changing the relative connections of the linkages 150, 152, on the respective slotted brackets 160, 162. Thus all of the motions previously described in applicant's prior patent and copending application can now be combined with the many motions afforded by the leg exercising apparatus 28. Although the present invention has been described with reference to preferred embodiments, workers skilled in the art will recognize that changes may be made in form and detail without departing from the spirit and scope of the invention.

I claim:

1. A passive exercising apparatus comprising:

(a) a first body exercising platform supported on a first frame and including means on the first frame enabling said first platform to pivot on said first frame about a first axis perpendicular to the central longitudinal axis of said first platform and to pivot about a second axis comprising the central longitudinal axis of said first platform or simultaneously pivot about both said axes;

(b) a second leg exercising apparatus on a second frame including a pair of outwardly extending leg supports pivotally supported on said second frame;

(c) connector means for detachably connecting said first and second frames together; and (d) a drive mechanism having detachable driving means operable when said frames are connected together for driving both said first platform and said leg supports simultaneously to cause said leg supports to pivot up-and-down in coordination with pivotal movement of said first platform about said axes.

2. A passive exercising apparatus comprising:

(a) a first stationary horizontal platform supported on a first frame and adapted to support as desired either a user's upper or lower body portion in a relatively fixed position;

(b) a second platform supported on a second frame and including means on the second frame enabling said second platform to pivot on said second frame about a first axis perpendicular to the central longitudinal axis of said second platform and to pivot about a second axis comprising the central longitudinal axis of said second platform or simultaneously pivot about both said axes;

(c) attachment means enabling said first and second platform frames to be detachably secured together with said second platform forming a lengthwise extension of said first platform, said attachment means also being formed such that when said first frame is detached from said second frame, said second frame is accessible for attachment to other exercising apparatus;

(d) a drive mechanism supported on said second frame below said second platform and having;

(i) a pair of laterally spaced lever arms mounted on opposite ends of a first horizontal drive shaft parallel to said first axis, at least one of said lever arms being angularly adjustable on said first drive shaft with respect to the other lever arm;

(ii) a linkage-bracket assembly including a pair of laterally spaced linkages, each said linkage being adjustably pivotally connected at one end to a respective one of a pair of brackets mounted on said second platform pivotally connectable to one of said lever arms; and (iii) means to drive said first drive shaft wherein said second platform is able to pivot up-and down about said first axis without or while simultaneously pivoting about said second axis to the extent permitted;

(e) with the extent of pivoting of said second platform permitted about each said axis being regulated by the angular relation of said levers, the positioning of the connections between said levers and linkages and the positioning of the connections between said linkages and brackets; and (f) a leg exercising apparatus on a third frame, means for detachably securing said third frame to said second frame, a pair of pivotal, outwardly extending leg supports supported on said leg exercising apparatus third frame and means driven by said first shaft drive means to cause said leg supports to pivot up-and-down in coordination with movement of said second platform.

3. A passive exercising apparatus comprising:

(a) a first stationary horizontal platform supported on a first frame and adapted to support as desired either a user's upper or lower body portion in a relatively fixed position;

(b) a second platform supported on a second frame and including means on the second frame enabling said second platform to pivot on said second frame about a first axis perpendicular to the central longitudinal axis of said second platform and to pivot about a second axis comprising the central longitudinal axis of said second platform or simultaneously pivot about both said axes;

(c) attachment means enabling said first and second platform frames to be detachably secured together with said second platform forming a lengthwise extension of said first platform, said attachment means also being formed such that when said first frame is detached from said second frame, said second frame is accessible for attachment to other exercising apparatus;

(d) a drive mechanism supported on said second frame below said second platform and having;

(i) a pair of laterally spaced lever arms mounted on opposite ends of a first horizontal drive shaft parallel to said first axis, at least one of said lever arms being angularly adjustable on said first drive shaft with respect to the other lever arm;

(ii) a linkage-bracket assembly including a pair of laterally spaced linkages, each said linkage being adjustably pivotally connected at one end to a respective one of a pair of brackets mounted on said second platform pivotally connectable to one of said lever arms; and (iii) means to drive said first drive shaft wherein said second platform is able to pivot up-and down about said first axis without or while simultaneously pivoting about said second axis to the extent permitted;

(e) with the extent of pivoting of said second platform permitted about each said axis being regulated by the angular relation of said levers, the positioning of the connections between said levers and linkages and the positioning of the connections between said linkages and brackets;

(f) a stationary bench member having a third frame with means for detachably securing said third frame to said second frame such that the user of said apparatus may assume a position of said bench member with the user's legs overhanging and the lower portion of the user's body supported on said bench member while the upper body portion of the user is exercised by said second platform; and (g) a fourth leg exercising apparatus on a fourth frame, means for detachably securing said fourth frame to said second frame, a pair of pivotal, outwardly extending leg supports supported on said leg exercising apparatus fourth frame and means driven by said first shaft drive means driven by said first drive shaft drive means to cause said leg supports to pivot up-and-down in coordination with movement of said second platform.

4. A passive exercising apparatus comprising:

(a) a first stationary horizontal platform supported on a first frame and adapted to support as desired either a user's upper or lower body portion in a relatively fixed position;

(b) a second platform supported on a second frame and including means on the second frame enabling said second platform to pivot on said second frame about a first axis perpendicular to the central longitudinal axis of said second platform and to pivot about a second axis comprising the central longitudinal axis of said second platform or simultaneously pivot about both said axes;

(c) attachment means enabling said first and second platform frames to be detachably secured together with said second platform forming a lengthwise extension of said first platform;

(d) a drive mechanism having detachable drive means for driving said second platform such that said second platform is able to pivot up-and-down about said first axis without or while simultaneously pivoting about said second axis to the extent permitted; and (e) a leg exercising apparatus on a third frame, means for detachably securing said third frame to said second frame, a pair of pivotal, outwardly extending leg supports supported on said leg exercising apparatus third frame and means detachably connected to and driven by said drive mechanism to cause said leg supports to pivot up-and-down in coordination with movement of said second platform.

5. A passive exercising apparatus as claimed in claim 2 wherein said outwardly extending leg supports each support a slidably mounted leg support platform with foot rest means thereon.

6. A passive exercising apparatus as claimed in claim 2 wherein said means to drive said first drive shaft comprises a variable speed motor.

7. A passive exercising apparatus as claimed in claim 2 wherein said first drive shaft is driven through a first chain and first sprocket drive and said means for causing said leg supports to move up-and-down comprises a second drive shaft mounted on said fourth frame and driven through a second chain and a second sprocket drive and both said first and second sprocket drive are driven by a common drive source.

8. A passive exercising apparatus as claimed in claim 4 including a stationary bench member having a fourth frame with means for detachably securing said fourth frame to said second frame such that the user of said apparatus may assume a position on said bench member with the user's legs overhanging and the lower portion of the user's body supported on said bench member while the upper body portion of the user is exercised by said second platform.

9. A passive exercising apparatus as claimed in claim 4 wherein said outwardly extending leg supports each support a slidably mounted leg support platform with foot rest means thereon.

10. A passive exercising apparatus as claimed in claim 4 wherein said drive mechanism comprises a first detachable chain and first sprocket drive for causing said leg supports to move up-and-down and a second detachable chain and a second sprocket drive for driving said second platform.

* * * * *